US005960418A

United States Patent [19]

Kelly et al.

[11] Patent Number: 5,960,418

[45] Date of Patent: Sep. 28, 1999

[54] MULTI-CURRENCY POSTAGE METER

[75] Inventors: Stephen Kelly, Welwyn Garden City; Timothy J Nicholls, Standon; Robert W Allport, Harlow, all of United Kingdom

[73] Assignee: Pitney Bowes Ltd., Stamford, Conn.

[21] Appl. No.: 08/892,240

[22] Filed: Jul. 14, 1997

[51] Int. Cl.[6] ..... G07B 17/00

[52] U.S. Cl. ..... 705/408; 101/71; 283/71

[58] Field of Search ..... 101/71; 283/71; 705/401, 405, 408, 410

[56] References Cited

U.S. PATENT DOCUMENTS

| | | | |
|---|---|---|---|
| 4,024,380 | 5/1977 | Gunn | 235/61.9 A |
| 4,218,011 | 8/1980 | Simjian | 235/375 |
| 4,286,325 | 8/1981 | Dlugos et al. | 705/402 |
| 4,471,441 | 9/1984 | Check, Jr. | 364/466 |
| 4,535,419 | 8/1985 | Dlugos et al. | 364/900 |
| 4,622,256 | 11/1986 | Brych | 428/131 |
| 4,835,713 | 5/1989 | Paster | 364/519 |
| 4,933,849 | 6/1990 | Connell et al. | 364/400 |
| 4,953,086 | 8/1990 | Fukatsu | 705/42 |
| 5,024,153 | 6/1991 | Bannister et al. | 101/91 |
| 5,024,282 | 6/1991 | Raikes et al. | 177/25.15 |
| 5,280,531 | 1/1994 | Hunter | 382/1 |
| 5,289,547 | 2/1994 | Ligas et al. | 382/7 |
| 5,293,319 | 3/1994 | DeSha et al. | 364/464.02 |
| 5,307,456 | 4/1994 | MacKay | 395/154 |
| 5,319,562 | 6/1994 | Whitehouse | 364/464.03 |
| 5,369,258 | 11/1994 | Sanson et al. | 235/381 |
| 5,397,125 | 3/1995 | Adams | 273/138 |
| 5,448,641 | 9/1995 | Pintsov et al. | 380/51 |
| 5,471,925 | 12/1995 | Heinrich et al. | 101/91 |
| 5,539,190 | 7/1996 | Manduley | 235/380 |
| 5,592,034 | 1/1997 | Felmus et al. | 307/130 |
| 5,602,742 | 2/1997 | Solondz et al. | 364/464.2 |
| 5,742,932 | 4/1998 | Levitsky | 705/410 |

FOREIGN PATENT DOCUMENTS

| | | |
|---|---|---|
| 0 336 589 A2 | 10/1989 | European Pat. Off. . |
| 0 491 392 A2 | 12/1991 | European Pat. Off. . |
| 3711 211 A1 | 10/1997 | Germany . |
| 1599578 | 10/1981 | United Kingdom . |
| 2230230 | 10/1990 | United Kingdom . |

OTHER PUBLICATIONS

United Kingdom Search Report for Foreign Counterpart Patent Application.

*Primary Examiner*—Edward R. Cosimano

*Attorney, Agent, or Firm*—Christopher J. Capelli; Melvin J. Scolnick

[57] ABSTRACT

The present invention provides an apparatus and method for converting a postage amount expressed in a first currency denomination into at least a second currency denomination and printing the postage amount expressed in a second denomination in postal indicia.

3 Claims, 4 Drawing Sheets

MULTI-CURRENCY POSTAGE METER

FIELD OF THE INVENTION

The present invention relates generally to an apparatus and method for determining postage. More particularly, the present invention relates to digital postage meter systems configured to determine and print postal indicia in more than one currency denomination.

BACKGROUND OF THE INVENTION

The "Euro" is a new currency that will replace the existing local currencies in select countries of the European Community. The Euro will have a fixed rate of exchange for each of the national currencies which fixed rate will be determined at the time each respective country joins. This fixed rate cannot change once it is set. The Euro is currently scheduled to exist as a currency from Jan. 1, 1999 but will only gradually move into general use, with the introduction of coins and notes in 2002. The Euro currency will have a subdenomination called a cent, which will be worth one hundredth of a Euro and the currency will be provided in the physical form of notes and coins. The length of time that banks and consumers will have to prepare themselves for the Euro currency differs. Of course relevant information will have to be given to the sectors concerned (public authorities, banks, businesses, etc.) and more general information to the individuals in order to meet the immediate demand for information needed to address the public's concerns and possible confusions.

One area that will be directly affected by the introduction of the Euro currency is postage meter systems. As are well known, postage meters are sophisticated systems that determine applicable postage for items to be mailed. Typically, such systems comprise a scale for determining the weight of an item to be mailed, a keyboard for entering data necessary to determine the applicable postage in accordance with the weight and entered data for each item to be mailed. One such apparatus is described in U.S. Pat. No. 4,286,325 to Dlugos, et al., for SYSTEM AND METHOD FOR COMPUTING DOMESTIC AND INFORMATIONAL POSTAGE, filed Aug. 27, 1979, which is hereby incorporated by reference.

There is concern that the assimilation of the Euro currency with postage meter systems will cause confusion with the users of such systems. Since the users of postage meter systems have become accustomed with their national currency denomination being printed on a postage label, they will be unfamiliar with a postage label bearing just the Euro currency denomination. In order to expedite the acceptance and assimilation of the Euro currency with postage meter systems, it is desirable to provide a postage machine that prints a postage label in both the Euro currency denomination and a converted national currency denomination (e.g., British Pounds Sterling (£)). Further, it is desirable to provide a postage meter system that permits the user to select which currency denomination is to be included in the postal indicia printed on the mail piece. However, though existing postage meter systems have proven to be highly adaptable, having the capability to handle numerous classes of service and being readily modified to deal with changing postal rates, such systems have heretofore lacked the capability to deal with postage values expressed in at least two currency denominations.

Thus it is an object of the present invention to provide a postage meter system that is adaptable to operate in conjunction with the Euro currency denomination and at least one other national currency denomination.

It is another object of the present invention to provide a postage meter system that prints a postage label in a selected national currency denomination.

SUMMARY OF THE INVENTION

The present invention provides an apparatus and method for converting postage expressed in a first currency denomination into at least a second currency denomination and printing the postage expressed in a second denomination in postal indicia.

The present invention includes a postage meter system that generates postage for items to mailed, which system includes input means for entering postage in a first currency denomination. The system includes an image generator that is connected to the input means and is capable of generating postal indicia in a digital bit-map. A printing device is connected to the image generator and is capable of printing the bit-map consisting of the postal indicia which is to be applied on items to be mailed. The meter system further includes conversions means for converting the input postage that is expressed in a first currency denomination into postage expressed in a second currency denomination.

BRIEF DESCRIPTION OF THE DRAWINGS

The above and other objects and advantages of the present invention will become more readily apparent upon consideration of the following detailed description, taken in conjunction with accompanying drawings, in which like reference characters refer to like parts throughout the drawings and in which.

DETAILED DESCRIPTION OF THE INVENTION

Figure 1:
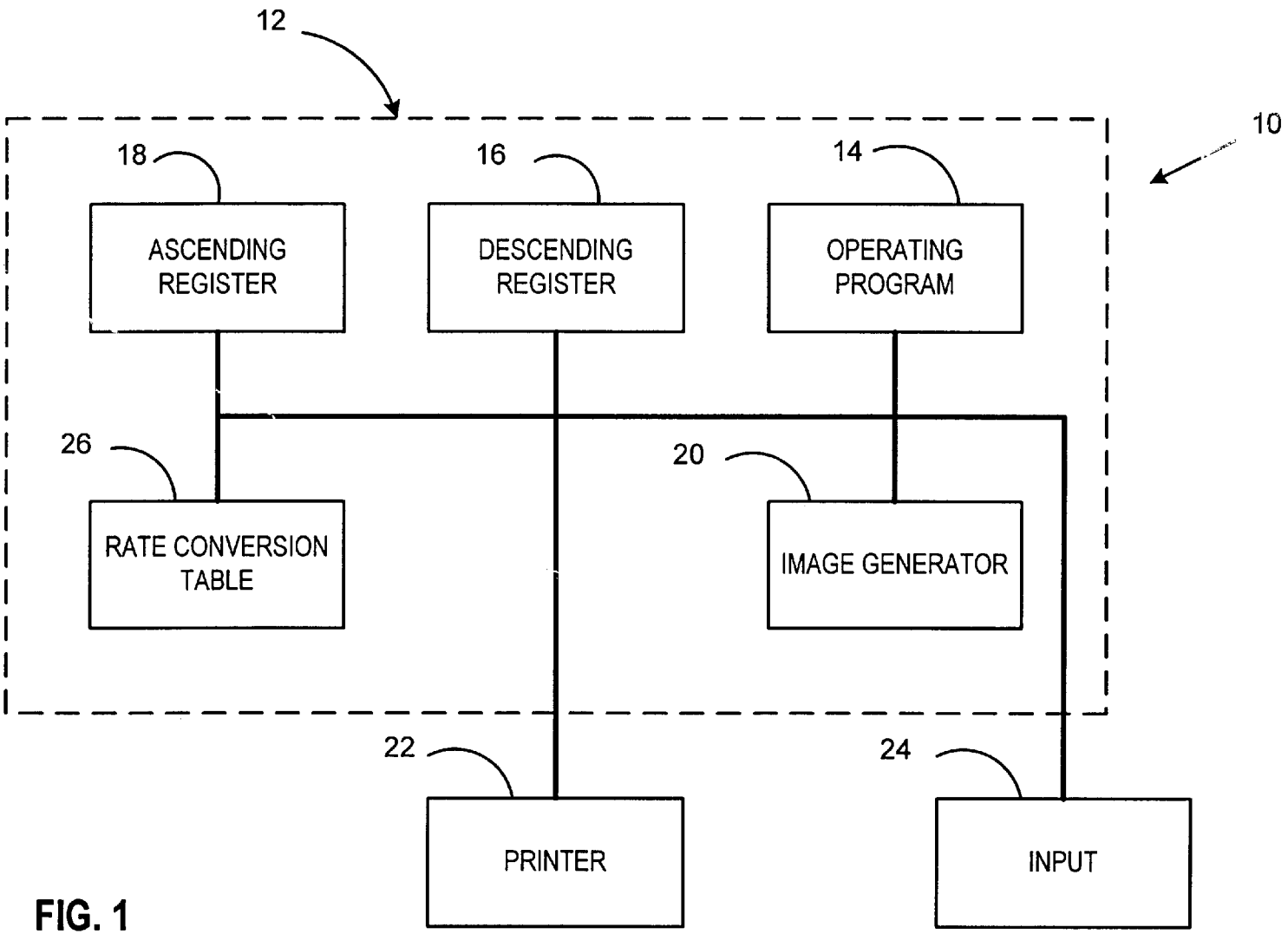
FIG. 1 is a block diagram embodying the system of the present invention.

In FIG. 1, there is shown generally at 10 an overall system in accordance with the present invention. In the embodiment illustrated, the system 10 comprises a computer controlled postage meter control system 12 (e.g. a digital postage meter), which is to be understood to be of any suitable configuration of hardware, software and framework. As is conventional and well known, the postage meter control system 12 includes an operating program 14, which provides the instructions for operating: an descending register 16; an ascending register 18; an image generator 20; a printer 22; and input means 24. As will be described in detail below, the postage meter control system 12 includes a rate conversion table 26 that is operative to enable system 12 to work in conjunction with both the Euro currency denomination and at least one other national currency denomination (e.g., British Pounds Sterling (£)). Since postage meter systems are well known in the art, the operation of such postage meter systems need not be described in detail herein except to the extent necessary for one skilled in the art to understand the present invention. Preferably, the present invention is to be implemented in postage meters commonly known as POST PERFECT and PERSONAL POST available from Pitney Bowes Inc. of Stamford Conn., U.S.A. Examples of such known postal meter systems can be found in the following commonly assigned U.S. Pat. No. : 4,535,419 to Dlugos, et al.; U.S. Pat. No. 5,280,531 to Hunter; and U.S. Pat. No. 5,592,034 to Felmus, et al., each of which is hereby incorporated by reference.

As is well known, the descending register 16 is preferably a resettable register that decrements an amount to which is being printed on a mail piece. The term "mail piece," as used herein, is to be understood to encompass any type of medium capable of bearing postal indicia, such as: post cards, envelopes, labels, tape strips and the like. It is to be appreciated that the descending register 16 can be configured to be either user selectable or fixed as to the currency denomination that is utilized by the descending register 16 for tracking postage funds. For ease of explanation of this illustrative embodiment, the descending register 16 will be maintained in conjunction with the Euro currency denomination. Similarly, and is also well known, the ascending register 18 increments an amount equal to that being printed on a mail piece and will also be maintained in conjunction with the Euro currency denomination. It is to be appreciated that system 12 is to be described in conjunction with a pre-payment postage system whereby the currency value prescribed in the descending register 16 must already be paid for by the user, after which the descending register 16 is decremented an amount equal to that contained in the generated postal indicia, which is to be printed on a mail piece. For example, when the descending register 16 of system 12 is equal to zero Euro's and the user pre-pays the Postal Office, either directly or indirectly, one hundred Euro's, the descending register 16 is correspondingly incremented to one hundred Euro's. Thus, when the system 12 is used to generate postal indicia equal to one Euro and five Cent, the descending register 16 is decremented by such an equal amount. As is conventional, when the descending register 16 does not contain an amount equal or greater to that which is desired to be printed, the operating program 14 prevents the system 12 from printing that amount until the descending register 16 is sufficiently incremented.

Eventhough the system 12 of the present invention is being described in terms of a "prepayment" postage system, it is to be understood that one skilled in the art could readily adapt system 12 to be utilized in a "post-payment" postal authority. Additionally, and as will be further described below, the descending and ascending registers 16 and 18 are not to be understood to be limited to be formatted in the Euro currency denomination as they may be formatted in any national currency denomination (e.g., British Pounds Sterling (£)).

The operating program 14 is preferably a set of instructions, which are typically implemented in a microprocessor that enables the control of the various components of the present invention postage meter system 12. As is conventional, the input device 24 consists of any known means capable of generating a currency value that is to be printed on a mail piece. For instance, the input device 24 may consist of: a scale; a keyboard; a bar code reader; or any other type of input device adapted for use with the generation of postal indicia. As is also conventional, the image generator 20 is preferably a device operative to generate a digital bit-map, which forms the postal indicia to be printed on a mail piece. The printer 22 is thus preferably a digital printer operative to print on a mail piece the aforesaid bit-map generated by the image generator 20.

Referring now to the rate conversion table 26, it is controlled by the operating program 14 and performs the conversion calculations necessary to generate at least one other alternative currency value in a second denomination which is equal to the input Euro currency denomination. For example, when the system 12 is instructed to generate postal indicia in both Euro and British Pounds Sterling currency denominations, the rate conversion table 24 converts the input Euro currency denomination into equivalent British Pounds Sterling (£) using the fixed rate of exchange. As will be described in more detail below, system 12 may be operative to simultaneously print two currency denominations on the mail piece, or may enable the user to selectively choose which currency denomination is to be printed on the mail piece.

Figure 2:
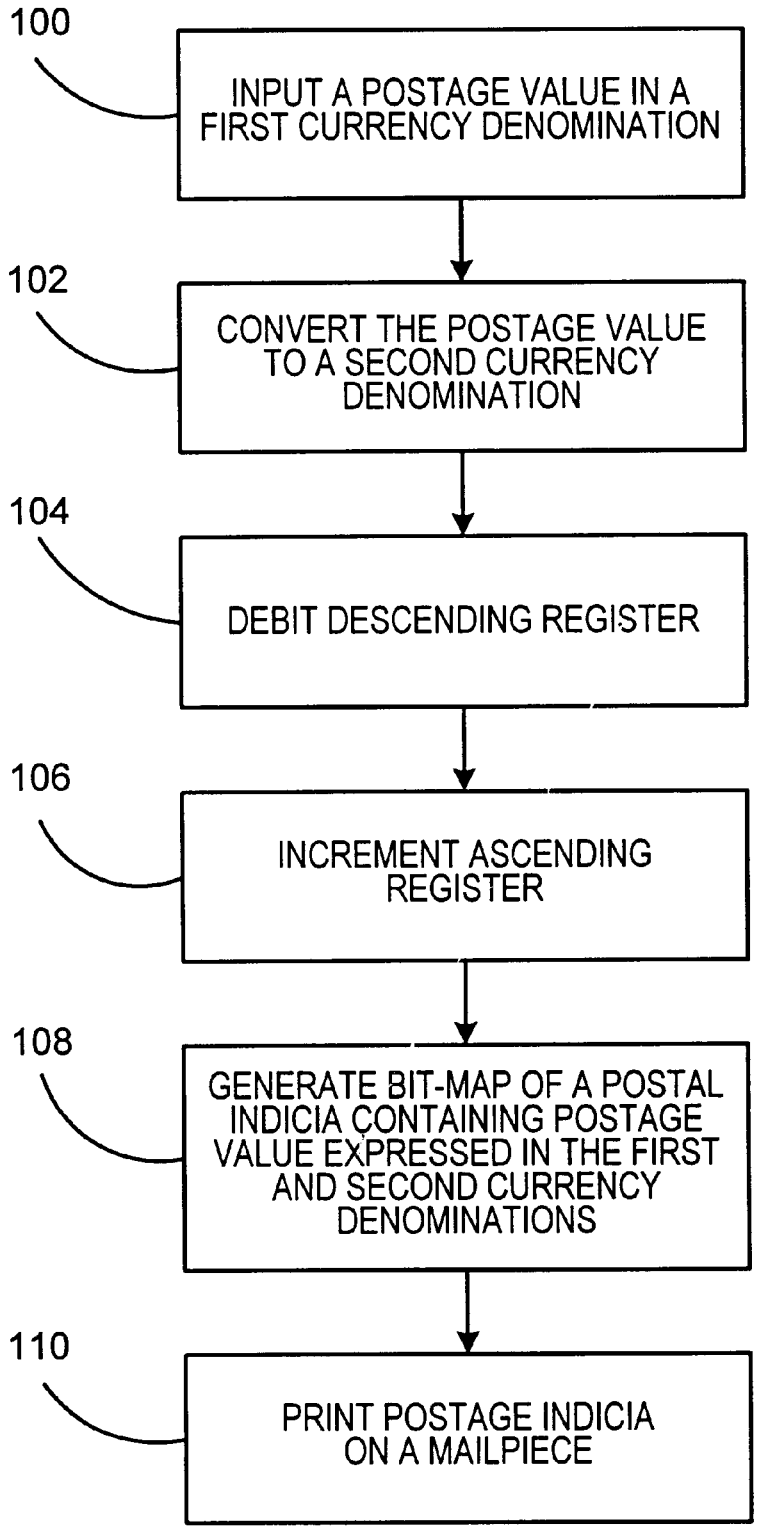
FIG. 2 is a flow chart depicting the method of use of the system of FIG. 1.

With the operating components of the present invention postage meter system 12 being described above, its method of operation will now be described in conjunction with reference to FIGS. 1 and 2. For ease of explanation, the descending register 16 is to be understood to be initially set to one hundred Euro's and the ascending register is to be understood to be initially set to zero Euro's.

First, a user inputs a postage value in a primary currency denomination (e.g., two Euros)(step 100). The rate conversion table 26 then converts the aforesaid postage using the fixed rate of exchange into a secondary currency denomination (e.g., British Pounds Sterling (£)) (step 102). The descending register 16 is decremented by an amount equal to the aforesaid primary currency value (e.g., two Euros (so as to equal ninety eight Euros)) and the ascending register 18 is correspondingly incremented (so as to equal two Euros) (steps 104 and 106).

The image generator 20 then generates a bit-map of postal indicia containing a postal value expressed in both the aforesaid primary currency denomination (e.g., Euros) and its corresponding secondary currency denomination (e.g., British Pounds Sterling (£))(step 108). The bit-map is then conveyed to the printer 22 which prints the bit-map on a mail piece (step 110).

Figure 3:
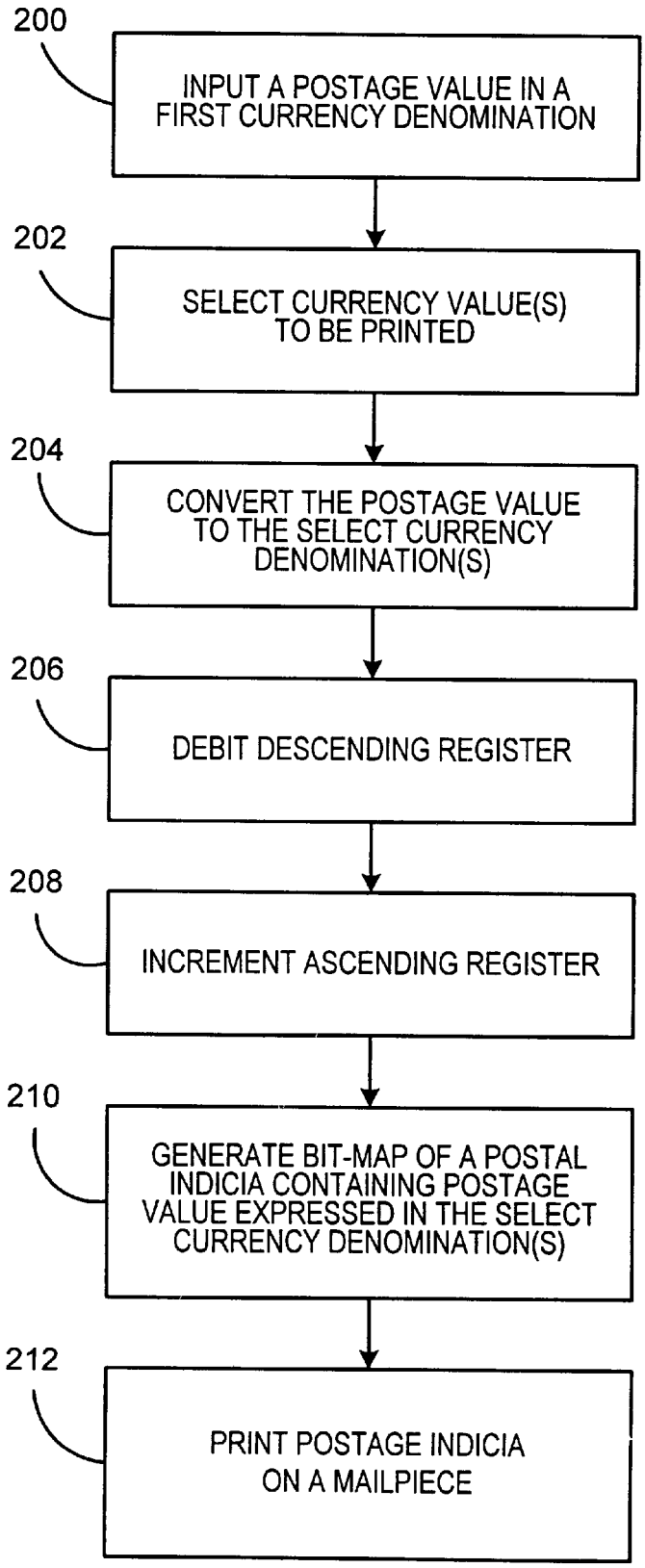
FIG. 3 is a flow chart depicting another method of use of the system of FIG. 1.

Another method of the operation of the present invention system 12 depicted in FIG. 1 will now be described in conjunction with reference to FIG. 3. First, a user inputs a postage value in a primary currency denomination (e.g., two (2) Euro's)(step 200). Next, the user is asked to input which currency denomination is to be printed on the mail piece (step 202). It is to be understood that the user may select from one or a plurality of preprogrammed currency denominations. For example, the user may choose that only British Pounds Sterling (£) are to be printed on the mail piece or that the Euro currency denomination, British Pounds Sterling (£) and German Deutsch Mark (DM) are to be all printed on the mail piece.

The rate conversion table 26 then converts the aforesaid entered primary currency denomination (e.g., Euros) into the selected currency denominations upon the instructions of the operating program 14 (step 204). Thus, if the user selects that in addition to the Euro value, both the British Pounds Sterling (£) and German Deutsch Mark (DM) currencies are to be printed on a mail piece, the rate conversion table 26 converts the entered Euro denomination value into both British Pounds Sterling (£) and German Deutsch Mark (DM) using the fixed rate of exchange established for the Euro currency denomination. As described above, the descending register 16 is then decremented by an amount equal to the aforesaid primary currency value and the ascending register is correspondingly incremented upon the instruction of the operating program 14 (steps 206 and 208).

Figure 3A:
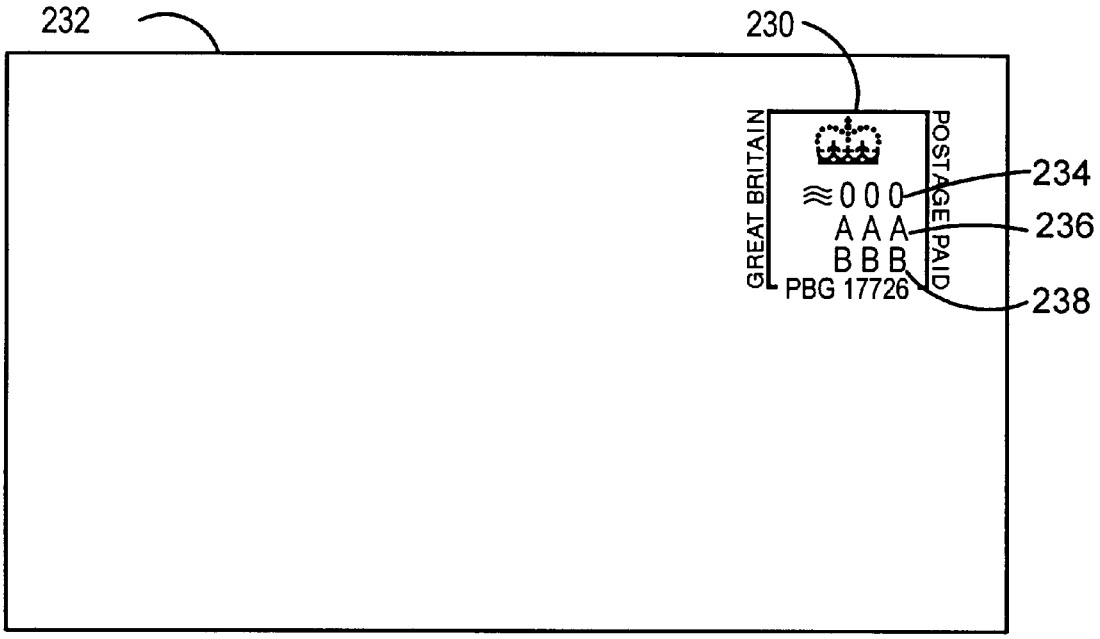
FIG. 3*a* is an imprint on a mail piece generated by the method of FIG. 3.

The image generator 20 then generates a bit-map of postal indicia containing a postal value expressed in aforesaid selected currency denominations (e.g., Euros, British Pounds Sterling (£) and German Deutsch Mark (DM))(step 210). This bit-map is then conveyed to the printer 22 which prints the bit-map 230 on a mail piece 232 as is shown in FIG. 3*a* (step 212), wherein the selected first, second and third selected currency denomination's are designated by reference numerals 234, 236 and 238, respectively.

In summary, a postage meter system and method that can perform the necessary conversion calculations for printing a selected currency denomination, or a plurality of selected currency denominations on a mail piece has been described. Although the invention has been described with emphasis on particular embodiments using postage metering techniques, it should be understood that the figures are for illustration of exemplary embodiments of the invention and should not be taken as limitations or thought to be the only means of carrying out the invention. Further, it is contemplated that many changes and modifications may be made to the invention without departing from the scope and spirit of the invention as disclosed.

What is claimed is:

1. A postage meter system that generates postal indicia for items to be mailed, comprising:

input means for entering a postage amount in a first currency denomination;

conversion means for converting the postage amount in the first currency denomination into a second currency denomination;

an image generator configured to generate the postal indicia in a bit map;

a printing device for printing the bit map on a mail piece; and control means for causing the image generator to generate the postal indicia in a bit map having both the first and second currency denominations and for causing the printing device to print the bit map on the items to be mailed.

2. A method for generating postal indicia in a postage apparatus having currency conversion means, the method comprising the steps of:

inputting a postage amount expressed in a first currency denomination;

converting the postage amount in the conversion means into a postage amount expressed in at least a second currency denomination; and printing the postal indicia in both the first and second currency denominations.

3. A method for generating postal indicia in a postage apparatus having currency conversion means, the method comprising the steps of:

inputting a postage amount expressed in a first currency denomination;

choosing at least one currency denomination from a plurality of predefined currency denominations to be included in the postal indicia that is to be printed on a mail piece;

converting the postage amount expressed in the first currency denomination to each of the chosen currency denominations; and printing the postal indicia in each one of the chosen currency denominations on a mail piece.

* * * * *